United States Patent [19]

Morishige

[11] 4,390,287

[45] Jun. 28, 1983

[54] ELECTRONIC DEVICE HAVING TIME DISPLAY FUNCTION

[75] Inventor: Morio Morishige, Hachioji, Japan

[73] Assignee: Casio Computer Co., Ltd., Tokyo, Japan

[21] Appl. No.: 210,036

[22] Filed: Nov. 24, 1980

[30] Foreign Application Priority Data

Dec. 5, 1979 [JP] Japan ..... 54-157911

[51] Int. Cl.[3] ..... G04C 19/00

[52] U.S. Cl. ..... 368/240; 368/251; 368/44; 368/82

[58] Field of Search ..... 368/239–242, 368/29–30, 41–44, 71–74, 79–80, 82–84, 228, 231, 250, 251, 256, 246

[56] References Cited

U.S. PATENT DOCUMENTS

| | | | |
|---|---|---|---|
| 4,007,583 | 2/1977 | Johnson | 368/29 |
| 4,045,951 | 9/1977 | Tanaka | 368/71 X |
| 4,121,415 | 10/1978 | Crutcher et al. | 368/240 X |
| 4,162,610 | 7/1979 | Levine | 368/41 |
| 4,272,836 | 6/1981 | Tamaru et al. | 368/74 |
| 4,277,840 | 7/1981 | Sekiya et al. | 368/74 X |

FOREIGN PATENT DOCUMENTS

| | | | |
|---|---|---|---|
| 2856714 | 7/1979 | Fed. Rep. of Germany . | |
| 2904946 | 8/1979 | Fed. Rep. of Germany . | |
| 54-118875 | 9/1979 | Japan | 368/240 |
| 1493640 | 11/1977 | United Kingdom . | |
| 2044963 | 10/1980 | United Kingdom . | |
| 2050657 | 1/1981 | United Kingdom . | |
| 2051429 | 1/1981 | United Kingdom . | |
| 2052111 | 1/1981 | United Kingdom . | |
| 2065339 | 1/1981 | United Kingdom . | |
| 2063530 | 6/1981 | United Kingdom . | |

*Primary Examiner*—B. A. Reynolds
*Assistant Examiner*—Philip H. Leung
*Attorney, Agent, or Firm*—Frishauf, Holtz, Goodman & Woodward

[57] ABSTRACT

In an electronic device having an function of displaying time in an optical analog display with pointers, the information on the position of the pointers on the analog display can be stored as digital information in a memory of the electronic device. The electronic device is multi-functional since it is capable of inputting or displaying time information for time schedules of buses, planes, and trains at the positions of the analog display.

7 Claims, 10 Drawing Figures

| | 59 | 58 | 57 | 56 | 55 | 54 | 53 | 52 | 7 | 6 | 5 | 4 | 3 | 2 | 1 | 0 |
|---|---|---|---|---|---|---|---|---|---|---|---|---|---|---|---|---|
| 0 | 0 | 0 | 0 | 0 | 0 | 0 | 1 | 0 | 0 | 1 | 0 | 0 | 0 | 0 | 0 | 0 |
| | 0 | 1 | 0 | 0 | 0 | 0 | 0 | 0 | 0 | 0 | 0 | 1 | 0 | 0 | 0 | 0 |
| 1 | 0 | 0 | 0 | 0 | 0 | 1 | 0 | 0 | 0 | 1 | 0 | 0 | 0 | 0 | 0 | 1 |
| | 0 | 0 | 1 | 0 | 0 | 0 | 0 | 0 | 0 | 0 | 0 | 0 | 0 | 1 | 0 | 0 |
| 22 | 0 | 0 | 1 | 0 | 0 | 0 | 0 | 0 | 0 | 0 | 1 | 0 | 0 | 0 | 0 | 1 |
| | 0 | 0 | 0 | 0 | 0 | 0 | 1 | 0 | 0 | 0 | 0 | 0 | 0 | 0 | 0 | 0 |
| 23 | 0 | 0 | 0 | 0 | 0 | 0 | 0 | 0 | 0 | 0 | 1 | 0 | 0 | 0 | 1 | 0 |
| | 0 | 1 | 0 | 0 | 0 | 0 | 0 | 1 | 0 | 0 | 0 | 0 | 0 | 0 | 0 | 0 |

| | 59 | 58 | 57 | 56 | 55 | 54 | 53 | 52 | 51 | 50 | 49 | 48 | --- | 8 | 7 | 6 | 5 | 4 | 3 | 2 | 1 | 0 |
|---|---|---|---|---|---|---|---|---|---|---|---|---|---|---|---|---|---|---|---|---|---|---|
| 15 | 1 | 0 | 0 | 0 | 0 | 0 | 0 | 0 | 0 | 0 | 1 | 0 | | 0 | 0 | 0 | 0 | 0 | 0 | 1 | 0 | 0 |
| | 0 | 0 | 0 | 0 | 0 | 1 | 0 | 0 | 0 | 0 | 0 | 0 | | 0 | 1 | 0 | 0 | 0 | 0 | 0 | 0 | 0 |

ELECTRONIC DEVICE HAVING TIME DISPLAY FUNCTION

BACKGROUND OF THE INVENTION

The present invention relates to an electronic device which has a function of displaying time in an optical analog display with pointers.

With an electronic device such as an electronic watch, it has been proposed to store a bus or train time schedule in a memory device such as a RAM (random access memory) and to read out the stored time information for display at a display unit as needed. However, for storing in advance many pieces of information for the time schedule, a plurality of switches must be operated. Thus, many pieces of time information to be stored result in complexity of the operation. With a compact electronic watch such as an electronic wristwatch of digital display type which is already on the market, the number of pieces of time information which may be displayed is limited to at most 2 or 3. It follows that displays must be switched a number of times for displaying desired time information among the many pieces of time information such as a time schedule. Thus, such a display is incapable of functioning as a time schedule display device.

The present invention has been made in consideration of this and has for its object to provide an electronic device which has a function of displaying time in an optical analog display with pointers, wherein the information on the positions of the pointers on the analog display is stored as digital information in a memory inside the electronic device. It is another object of the present invention to provide an electronic device of the type described above which is capable of setting the time information of time schedules for buses, trains, planes and so on with extreme ease utilizing an analog diaplay. It is still another object of the present invention to provide an electronic device of the type described above which is capable of simultaneously displaying many pieces of time information, utilizing an analog display. It is still another object of the present invention to provide an electronic device of the type described which is capable of displaying different types of time information simultaneously but in a well distinguished manner.

SUMMARY OF THE INVENTION

According to the present invention, an electronic device having a timing display function comprises present time counting means for counting reference signals to obtain present time data comprised of at least hour unit data and minute unit data; analog display means including at least 60 optical indicators for causing the present time data obtained at the present time counting means to be displayed by the display position of selected indicators of said at least 60 optical indicators; time data storing means for storing a plurality of time data different from the present time data obtained at the present time counting means, the time data stored in the time data storing means comprising at least hour unit data and minute unit data; readout means for selectively causing only a plurality of different time data which are of the order of hour unit data the same as hour unit data obtained at the present time counting means to be read out of the time data storing means; and display control means coupled to the display means and to the readout means for causing at least the minute unit date of said plurality of different time data read out by the readout means to be simultaneously displayed by the display position of selected indicators of said at least 60 optical indicators.

According to the present invention, many pieces of time information may be simultaneously displayed with a compact electronic device with an extremely small display area. Thus, an extremely convenient electronic device is provided.

This invention can be more fully understood from the following detailed description when taken in conjunction with the accompanying drawings.

DETAILED DESCRIPTION

Figure 1A:
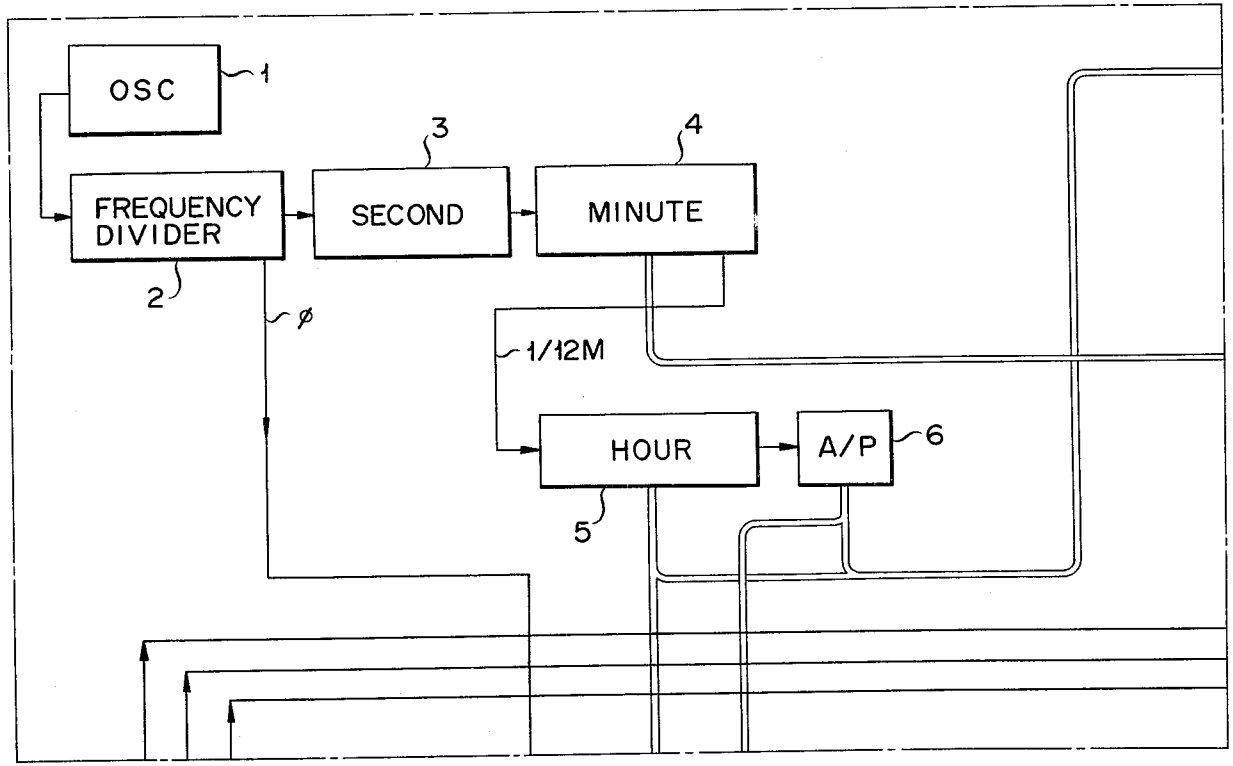
FIGS. 1A to 1D show circuit diagrams of an electronic wristwatch according to the present invention.
Figure 1B:
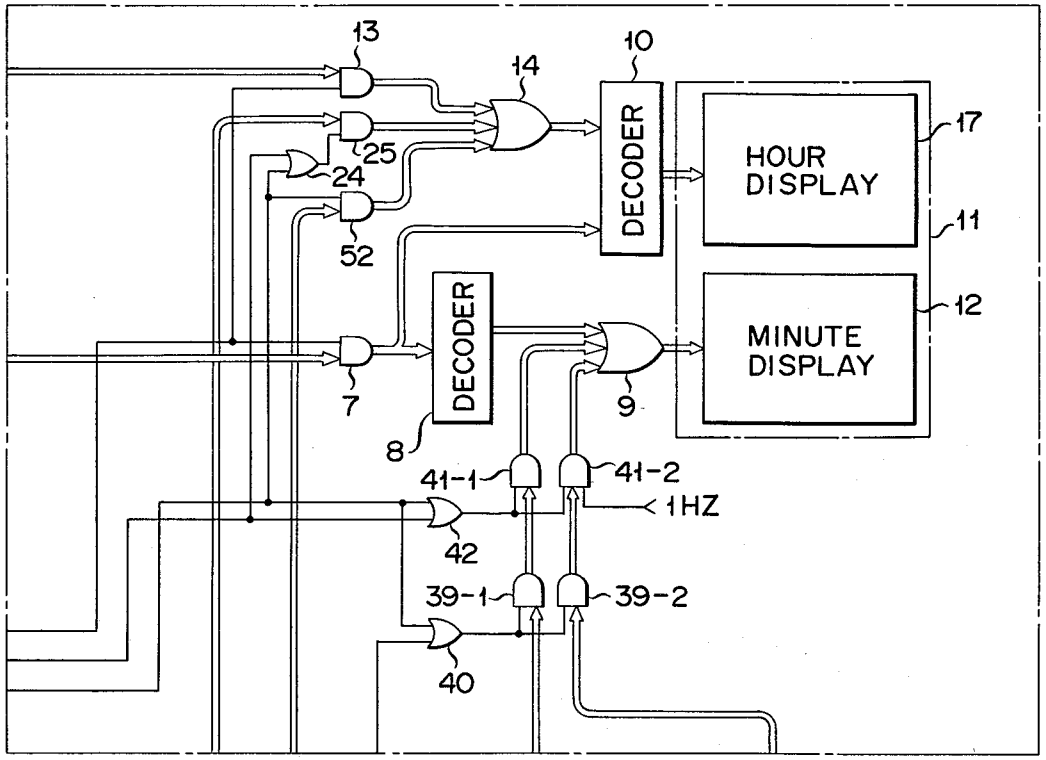
Figure 1C:
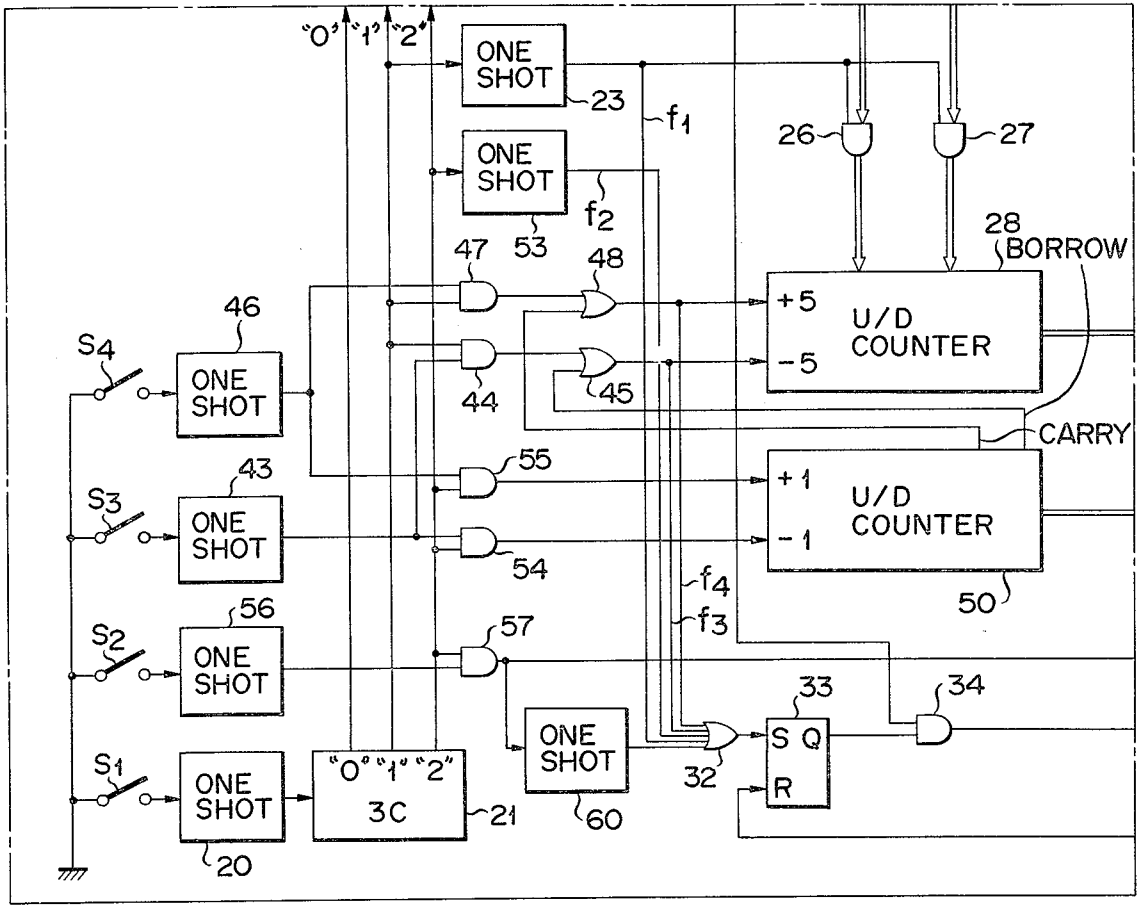
Figure 1D:
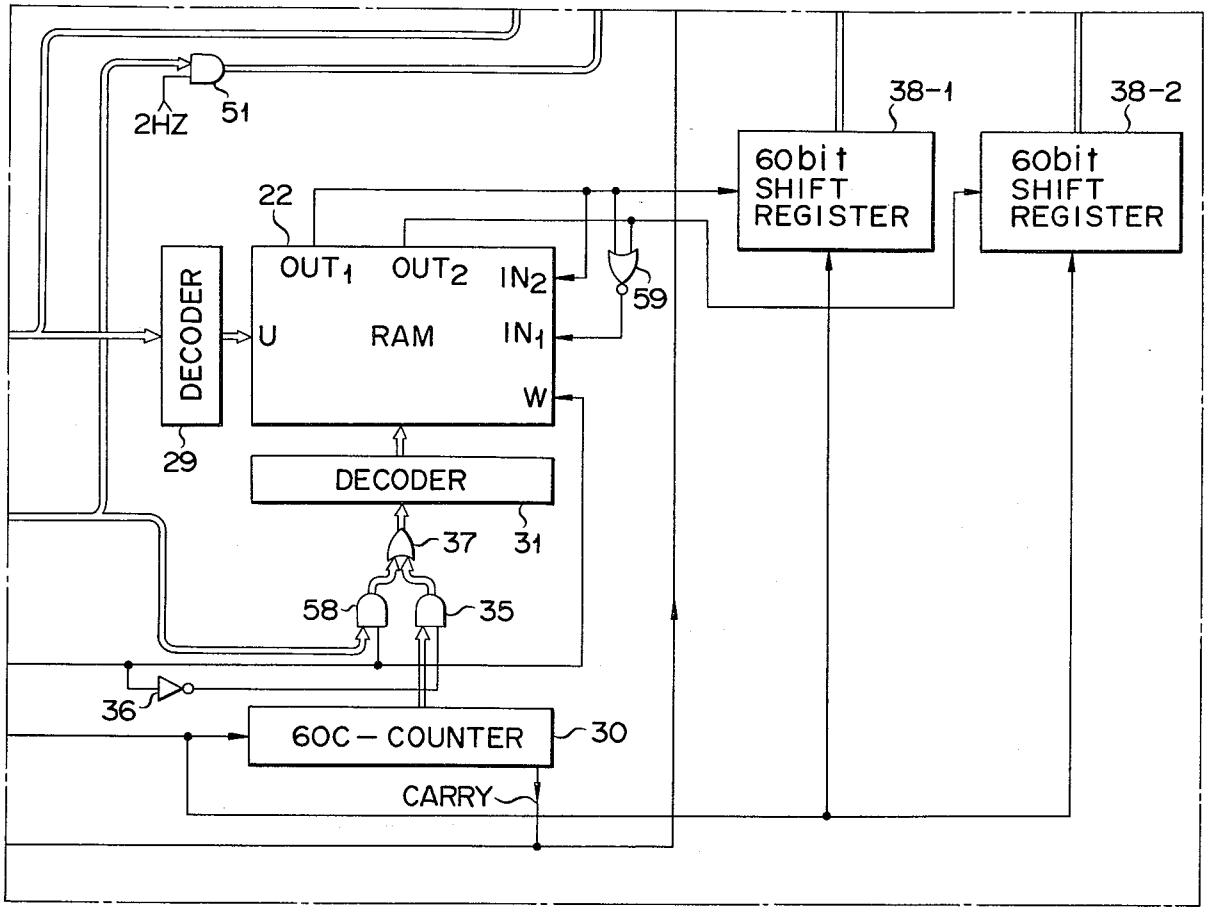
Figure 2:
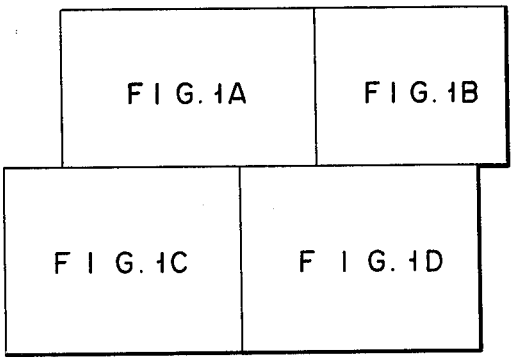
FIG. 2 shows the relative arrangement of FIGS. 1A to 1D.

FIGS. 1A to 1D are combined in the manner shown in FIG. 2. Referring to FIG. 1A, numeral 1 denotes an oscillator. Reference frequency signals outputted from the oscillator 1 are frequently divided into signals of one second period by a frequency divider 2, and the signals of one second period are input to a second counter 3 (sexagenary counter) and counted. A carry signal for every minute from the second counter 3 is input to a minute counter 4 (a sexagenary counter connecting a duodecimal counter and a quinary counter) and counted. A pulse signal 1/12.M outputted once every 12 minutes from the minute counter 4 is input to an hour counter 5 (a sexagenary counter) and counted. A carry signal outputted once every 12 hours from the hour counter 5 is input in a AM/PM counter 6 (binary counter) and counted. A signal (minute information) representing the contents of the minute counter 4 is input to a decoder 8 and a decoder 10 through an AND gate 7 as shown in FIG. 1B and decoded. The minute information decoded by the decoder 8 is supplied to a time display unit 11 through an OR gate 9 and displayed at a minute display unit 12 of the time display unit 11. A signal (hour information) representing the contents of the hour counter 5 and the AM/PM counter 6 as shown in FIG. 1A is input to the decoder 10 through an AND gate 13 and an OR gate 14, as shown in FIG. 1B. The minute information and hour information input to the decoder 10 are decoded and supplied to the time display unit 11 to be displayed at an hour display unit 17 of the time display unit 11.

Figure 3:
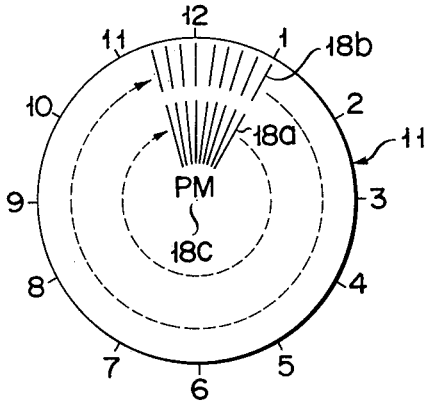
FIG. 3 shows the construction of the time display unit 11 shown in FIG. 1B.

The construction of the time display unit 11 shown in FIG. 1B will be described referring to FIG. 3. The time display unit 11 is a liquid crystal display unit which optically displays (in an analog display) the minute information and the hour information with the pointers.

The hour display unit 11 shown in FIG. 1B comprises a group 18*a* of sixty first liquid crystal electrode elements equidistantly arranged in a circle about the center of the time display unit 11 and a liquid crystal electrode display element 18*c* forming a PM mark at the center. The minute display unit 12 shown in FIG. 1B comprises a group 18*b* of sixty second liquid crystal electrode elements outside the first electrode element group 18*a* and in radial alignment therewith. The display of "hour" is accomplished by selecting an element of the first liquid crystal electrode element group 18*a*. The display of "minute" is accomplished by selecting an element of the first liquid crystal electrode element group 18*a* and an element of the second liquid crystal electrode element group 18*b* which are located on extended radii passing through the first liquid crystal electrode element group 18*a*. Around the outer circumference of the time display unit 11, numerals 1, 2, . . . 12 are displayed by printing, for example, as in the case of a conventional analog watch in correspondence with the first and second liquid crystal electrode element groups 18*a* and 18*b*. The PM liquid crystal electrode display element 18*c* for displaying AM/PM is lit as "PM" when the contents of the AM/PM information are PM. It is turned off when the contents are AM, and no display is made. Since the first and second liquid crystal electrodes element groups 18*a* and 18*b* and the PM liquid crystal electrode display element 18*c* all comprise liquid crystal display elements, the minute display unit 12 and the hour display unit 17 both include liquid crystal driving circuits.

Referring to FIG. 1C, S1 denotes a display change-over switch. When this switch S1 is operated, one pulse signal is outputted from a one-shot circuit 20 and supplied to a ternary counter 21. The contents of the ternary counter 21 change according to "0", "1", "2", "0", . . . every time the display change-over switch S1 is operated. The signals outputted when the contents of the ternary counter 21 are "0", "1" and "2" will be referred to as signals "0", "1" and "2", respectively. The signal "0" is input to the AND gates 7 and 13 as a control signal. When the contents of the ternary counter 21 are "0", the general counted time from the minute counter 4, the hour counter 5 and the AM/PM counter 6 shown in FIG. 1A is supplied to the time display unit 11 shown in FIG. 1B and displayed. The signal "1" from the ternary counter 21 is input to a one-shot circuit 23 as well as through an OR gate 24 to an AND gate 25 as a control signal. When the contents of the ternary counter 21 change from "0" to "1", a signal f1 is outputted from the one-shot circuit 23 and is input to AND gates 26 and 27 as a control signal. Signals indicating hour information from the hour counter 5 and the AM/PM counter 6 are input to the AND gates 26 and 27, respectively. The pulse signal f1 release the control of the AND gates 26 and 27 simultaneously so that the hour information and the AM/PM information are outputted from the AND gates 26 and 27 and are preset in an up and down counter 28. The up and down counter 28 comprises sexagenary and binary up and down counters, which are of the same notations as the hour counter 5 and the AM/PM counter 6, respectively. The hour information consisting the hour combined with the AM/PM information preset in the up and down counter 28 is outputted from an AND gate 25 to which is supplied the signal "1" from the ternary counter 21 through the OR gate 24. The hour information is decoded by the decoder 10 through the OR gate 14 and displayed at the hour display unit 17. The hour information preset in the up and down counter 28 is input to a decoder 29 shown in FIG. 1D and decoded thereby. The decoded information is then input to a column address input terminal U of a RAM 22 as a column address signal. The RAM 22 is formed in a matrix of 24 columns×60 rows and is so constructed that 2 bit parallel outputs may be obtained from data output terminals OUT1 and OUT2 from each column. Thus, each column comprises a register of 60 bits, and column addresses 0 to 23 are assigned to each column. Each address is capable of storing "1" or "0". Each column thus corresponds to the hour unit of 0 to 23 hours, and each row corresponds to the minute unit of 0 to 59 minutes. The column address is specified in correspondence to the hour information of the up and down counter 28.

A row address signal of the RAM 22 is sequentially obtained by decoding the contents of a sexagenary counter 30 by a decoder 31. When the signal f1 is input through an OR gate 32 to a set input terminal S of an SR type flip-flop 33 and the set output signal of the flip-flop 33 is input as a control signal to one of the input terminals of an AND gate 34, a pulse signal $\phi$ (e.g., 1,024 Hz) obtained from the frequency divider 2 connected to the other terminal is outputted from the AND gate 34. The pulse signal $\phi$ outputted from the AND gate 34 is input to and counted by the sexagenary counter 30. The counted value of the sexagenary counter 30 is input to the decoder 31 through an AND gate 35 and an OR gate 37. Then, the decoder 31 outputs the values obtained by sequentially decoding the counted values 0 to 59 counted by the sexagenary counter 30 as the row address signal to a row address input terminal L of the RAM 22. Accordingly, from the data output terminals OUT1 and OUT2 of the RAM 22 are sequentially read out, as 2 bit parallel outputs, the stored information of all the column addresses specified by the column address signals from the decoder 29. The stored information is written in 60 bit shift registers 38-1 and 38-2 which take the pulse signal $\phi$ from the AND gate 34 as a shift signal. Parallel data of respective bits written in these shift registers 38-1 and 38-2 are input to AND gates 39-1 and 39-2 shown in FIG. 1B. When the carry signals of the sexagenary counter 30 are supplied to the AND gates 39-1 and 39-2, respectively, through an OR gate 40, the parallel data are outputted from the AND gates 39-1 and 39-2, respectively. The parallel data are supplied to and displayed by the minute display unit 12 through the OR gate 9 and AND gates 41-1 and 41-2 to which the signal "1" is supplied through an OR gate 42. In this case, a signal of 1 Hz frequency obtained from the frequency divider 2 is input to the AND gate 41-2. Thus, the parallel data read out from the shift register 38-2 is displayed at the minute display unit 12 as flashing with the frequency 1 Hz. The parallel data obtained from the shift register 38-1 through the AND gate 41-1 is displayed by constant illumination at the minute display unit 12.

The carry signal of the sexagenary counter 30 of FIG. 1C is also input to the reset input terminal of the flip-flop 33, so that the flip-flop 33 is reset when the carry signal is outputted.

The signal "1" of the ternary counter 21 of FIG. 1C is also input to AND gates 44 and 47. Operating signals of a return switch S3 and a forward switch S4 are supplied to these AND gates 44 and 47 through one-shot circuits 43 and 46. The pulse signal outputted from the AND gate 44 upon operation of the switch S3 is supplied as a −5 signal to the input terminal of the up and down counter 28 through an OR gate 45 and subtracts 5 from the contents of the up and down counter 28. The fact that 5 is subtracted from the contents of the up and down counter 28 indicates that the hour information of the up and down counter 28 is diminished by 1 hour. Thus, the column address signal supplied to the RAM 22 through the decoder 29 specifies the hour unit for one hour before. Since the signal (pulse signal f3) outputted from the OR gate 45 is also input to the set input terminals S of the flip-flop 33 through the OR gate 32, the flip-flop 33 is reset. Then, the row specification of the RAM 22 is performed again, and the stored information of the hour unit for one hour before is written in the shift registers 38-1 and 38-2, respectively. The information written in these shift registers 38-1 and 38-2 is supplied to the minute display unit 12 through the OR gate 9 and the AND gates 39-1, 39-2, 41-1, and 41-2 of FIG. 1B and is displayed at the minute display unit 12. The pulse signal outputted from the AND gate 47 shown in FIG. 1C is outputted as a pulse signal f4 from an OR gate 48 and is supplied to the up and down counter 28 as a +5 signal to increment the contents of the up and down counter 28 by 5. As a result, the contents of the up and down counter 28 indicates the hour information for one hour later. Since the pulse signal f4 is input to the set input terminal S of the flip-flop 33 through the OR gate 32 to reset the flip-flop 33, the stored information for one hour later from the RAM 22 is in the shift registers 38-1 and 38-2 and is displayed at the minute display unit 12.

The signal "2" from the ternary counter 21 of FIG. 1C is input to the AND gate 25 through the OR gate 24. When the contents of the ternary counter 21 are "2", the hour information in the up and down counter 28 is outputted from the AND gate 25 and is displayed at the hour display unit 17. Numeral 50 in FIG. 1C denotes a sexagenary up and down counter for setting and clearing the time as described hereinafter. The signal representing the contents of the up and down counter 50 is input to one of the input terminals of an AND gate 51 shown in FIG. 1D. A rectangular signal of 2 Hz frequency is input as a control signal to the other input terminal of the AND gate 51. The output signal from the AND gate 51 is input to the decoder 15 through an AND gate 52 and an OR gate 14 which are released by the signal "2" from the ternary counter 21 of FIG. 1C. Thus, the contents of the up and down counter 28 of FIG. 1C are displayed at the time display unit 11 of FIG. 1B, and the contents of the sexagenary up and down counter 50 are also displayed as flashing with a frequency of 2 Hz. The signal "2" from the ternary counter 21 is input to AND gates 54 and 55 as well as to a one-shot circuit 53. As a result, when the contents of the ternary counter 21 change from "1" to "2", a pulse signal f2 is outputted from the one-shot circuit 53. This pulse signal f2 is input to the set input terminal S of the flip-flop 33 through the OR gate 32. Thus, the counted values of the sexagenary counter 30 to which the pulse signal $\phi$ is supplied are decoded by the decoder 31 and are input as row address signals to the RAM 22. Therefore, the stored information corresponding to the hour information of the up and down counter 28 is displayed at the minute display unit 12 of the time display unit 11. The operating signals of the switches S3 and S4 are supplied to the AND gates 54 and 55 of FIG. 3C through the one-shot circuits 43 and 46, respectively. When the switch S3 is operated, the pulse signal outputted from one-shot circuit 43 is input to the up and down counter 50 as a −1 signal. When the switch S4 is operated, the pulse signal outputted from the one-shot circuit 46 is supplied to the up and down counter 50 through the AND gate 55 as a +1 signal. Since the contents of the up and down counter 50, which have been decreased or incremented by 1 upon the operation of the switches S3 or S4, are displayed by flashing at the hour display unit 17, the return switch S3 or the forward switch S4 may be continuously operated while confirming the contents by visual observation. A carry signal and a borrow signal outputted from a carry output terminal and a borrow output terminal, respectively, of the up and down counter 50 are input to the up and down counter 28 through the OR gates 48 and 45 as a +5 signal and a −5 signal. The contents of the up and down counter 50 are supplied to one of the input terminals of an AND gate 58. The operating signal of a setting switch S2 is supplied to the other of the input terminals of the AND gate 58 through a one-shot circuit 56 and an AND gate 57 to which the signal "2" is supplied. The output signal of the AND gate 57 is supplied to the AND gate 35 through an inverter 36 and is also supplied to a writing command terminal W of the RAM 22 as a writing command signal. When the setting switch S2 is operated, the address information for the hour unit of the up and down counter 28, and for the minute unit of the up and down counter 50, are read out from the data output terminals OUT1 and OUT2, respectively, of the RAM 22 as 2 bit parallel outputs. Thus, the bit output from the data output terminal OUT1 is input to a data input terminal IN2 of the RAM 22. The respective bit outputs from the data output terminals OUT1 and OUT2, that is, the 2 bit parallel outputs, are input to a data input terminal IN1 of the RAM 22 through a NOR gate 59. The data input terminal IN1 is connected to the data input terminals of the upper 60 bit register of the two 60 bit registers comprising each column of the RAM 22 described with reference to FIG. 4. The data input terminal IN2 is connected to the data input terminals of the lower 60 bit register. Due to such connections between the data output terminals OUT1 and OUT2 and the data input terminals IN1 and IN2, when the contents of the 2 bit parallel outputs are "0" when outputted from the data output terminals OUT1 and OUT2 upon operation of the setting switch S2 the first time, the output of the NOR gate 59 becomes "1". Thus, "1" is written in the corresponding row (bit) of the upper 60 bit register of the column through the data input terminal IN1. Since the input to the data input terminal IN2 is "0" at this time, the contents of the corresponding bit of the lower 60 bit register of the column do not change from "0". When the setting switch S2 is operated again under the condition "1" is written, "1" is outputted from the data output terminal OUT1, and "0" is outputted from the data output terminal OUT2. Thus, the output of the NOR gate 59 becomes "0", so that "0" is supplied to the data input terminal IN1 and "1" is supplied to the data input terminal IN2. Thus, "0" is written in the bit of the upper 60 bit register and "1" is written in the corresponding bit of the lower 60 bit register. As a result, the stored condition of the respective bit obtained is inverted upon operating the setting switch S2 for the first time. The output of the RAM 22 from the data output terminal OUT1 is input to the shift register $38_1$, and the output of the RAM 22 from the data output terminal OUT2 is input to the shift register $38_2$. When it is desired to display by flashing the time information which has been displayed by constant illumination at the minute display unit 12, the setting switch S2 need only be operated again.

Figures 4, 6, 7:
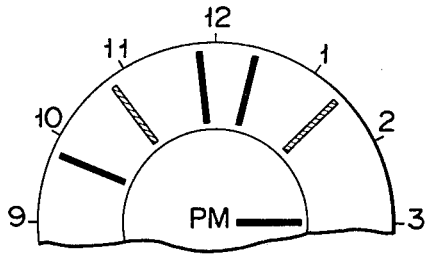
FIG. 4 shows the contents of the RAM 22 shown in FIG. 1D.
FIG. 6 shows partially the stored condition of the RAM 22.
FIG. 7 shows the display condition of the time display unit displaying the contents of the RAM 22 shown in FIG. 6.
Figure 5:
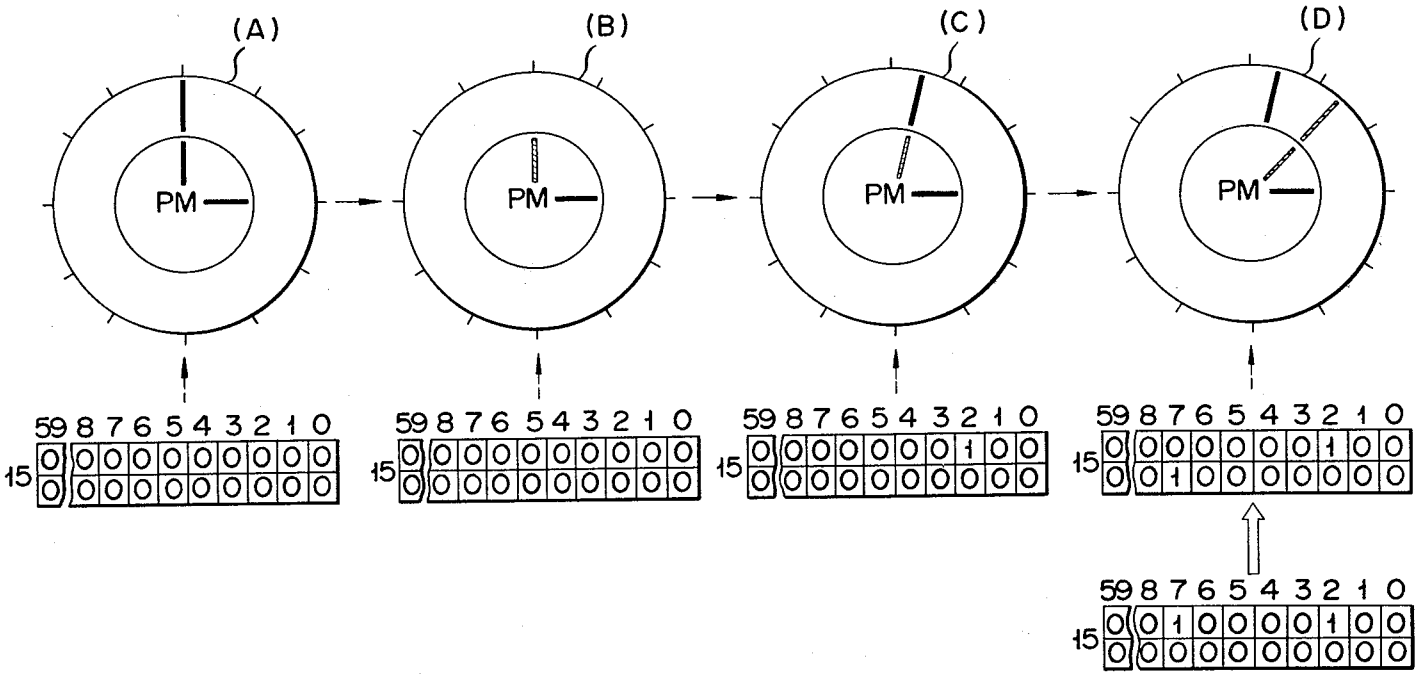
FIG. 5 shows the relation between the display condition of the time display unit 11 and the stored condition of the RAM 22 when setting the time.

The mode of operation together with the operating method of the above embodiment will be described with reference to FIGS. 5 to 7. When the contents of the ternary counter 21 of FIG. 1C are "0", the signal "0" alone is outputted from the ternary counter 21. This signal "0" is supplied to the AND gates 7 and 13 of FIG. 1B and releases control of the AND gates 7 and 13. Thus, the minute information from the minute counter 4 is input to the decoder 8, and the hour information from the hour counter 5 and the AM/PM counter 6 of FIG. 1A is input to the decoder 10. The decoded outputs from the decoders 8 and 10 are supplied to the time display unit 11, and a predetermined liquid crystal electrode element is selected. The present time, 3:00 PM for example, is displayed at the time display unit 11 as shown in FIG. 5A.

For storing train departure times between 3:00 and 3:59 PM in the train time schedule when a general time such as 3:00 PM is displayed at the time display unit 11, the display change-over switch S1 is operated twice in succession. In this case, upon the first operation of the switch S1, in response to the first pulse signal from the one-shot circuit 20, the contents of the ternary counter 21 change from "0" to "1", and the signal "1" is outputted from the ternary counter 21. Therefore, a signal f1 is generated from the one-shot circuit 23 and the AND gates 26 and 27 are released from the control, then, the hour information, that is, 3 PM is transferred from the hour counter 5 and the AM/PM counter 6 to the up and down counter 28 and is preset. The preset time information "3 PM" is supplied through the AND gate 25 and the OR gate 14 to the decoder 10 and decoded thereby. Then, the liquid crystal electrode display element 18c and the first liquid crystal electrode element of the time display unit 11 for displaying 3 PM are selected to be lit so that 3 PM is displayed by the time pointers. The hour information "3 PM" is also decoded by the decoder 29. As a result, a column address signal of content "15" is supplied to the column address input terminal U of the RAM 22. In response to the signal f1 outputted upon the first operation of the switch S1, the flip-flop 33 is set. The sexagenary counter 30 counts the pulse signals $\phi$ and its contents change from "0" to "59". The contents "0" to "59" are decoded by the decoder 31 and are supplied to the row address input terminal L of the RAM 22. The information of 3:00 PM to 3:59 PM of the RAM 22 is sequentially read out from the data output terminals OUT1 and OUT2 and is input to the shift registers $38_1$ and $38_2$, respectively. However, since nothing is written for 3:00 to 3:59 PM and the information read out from the RAM 22 is "0", the first liquid crystal electrode element and the second liquid crystal electrode element of the minute display unit 12 are not selected at all so that the minute pointer is not displayed.

Since the AND gates 7 and 13 are simultaneously closed when the contents of the ternary counter 21 change from "0" to "1", the present time information by the counters 4, 5 and 6 is longer supplied to the time display unit 11, and no display is made.

Upon the second operation of the switch S1, the contents of the ternary counter 21 change from "1" to "2", and the signal "2" is outputted from the ternary counter 21. The AND gates 54, 55 and 57 are opened simultaneously with this, and the AND gates 25, 52, 39-1, 39-2, 41-1 and 41-2 are also opened so that a pulse signal f2 is generated. If it is assumed that the contents of the up and down counter 50 are "0", a signal representing the contents "0" is outputted from the AND gate 51 at a frequency 2 Hz and is supplied to the decoder 10 through the AND gate 52 and the OR gate 14 to be decoded. Therefore, the first liquid crystal electrode element corresponding to the contents "0" is selected and begins to flash at the time display unit 11 as shown in FIG. 5B. The flip-flop 33 is set when the signal f2 is generated and the contents of the sexagenary counter 30 change from "0" to "59" so that the display at the minute display unit 12 is not effected, for the same reason as has been described with reference to the case where the signal f1 is generated.

When the forward switch S4 is operated twice in succession for writing the departure time of an ordinary train, "3:02 PM," the contents of the up and down counter 50 are incremented by "2" and become "32". Simultaneously, a signal representing the contents "2" is outputted from the AND gate 51 at a frequency 2 Hz so that the corresponding first liquid crystal electrode element starts flashing at the hour display unit 17. When the setting switch S2 is operated once after visually observing the flashing operation, a signal is generated from the AND gate 57. This signal opens the AND gate 58 and closes the AND gate 35. Thus, the contents "2" of the up and down counter 50 are decoded by the decoder 31, and the area corresponding to 3:02 PM of the RAM 22 is addressed. The time is not written in the area for 3:02 PM, so that "0" is outputted from the data output terminals OUT1 and OUT2. Consequently, the output of the NOR gate 59 becomes "1" and is supplied to the data input terminal IN1, and "0" is supplied to the data input terminal IN2. The above-mentioned signal from the AND gate 57 is input to the write command terminal W at this time. Therefore, "1" is written in the bit of row address "2" corresponding to 3 PM to 3:59 PM of the upper 60 bit register of the two 60 bit registers, and "0" is written in the corresponding bit of the lower 60 bit register.

After completion of the writing operation, the flip-flop 33 is set by the output of a delay circuit 60. The sexagenary counter 30 operates, and its contents change from "0" to "59". The contents "0" to "59" are supplied to the decoder 31 through the AND gate 35 and the OR gate 37 which are open at this time. The information on 3:00 to 3:59 PM in the RAM 22 is read and is sequentially input to the shift register $38_1$ and $38_2$. As a result, the first liquid crystal electrode element and the second liquid crystal electrode element for displaying "2 minutes" are selected and are displayed as the minute pointer of the minute display unit 12. In this case, the minute information read out from the shift register 38-1 is displayed in a manner as shown in FIG. 5C. The first liquid crystal electrode element flashes at a frequency 2 Hz according to the contents of the up and down counter 50, and the second liquid crystal electrode element is lit.

Now it is assumed that the time 3:07 PM is to be set. Since the time "3:07 PM" is the departure time for an express train, it is read out from the RAM 22 and is stored in the lower 60 bit register to be displayed by flashing at the minute display unit 12. In this case, the forward switch S4 is operated five times in succession after the writing operation described above, and the contents of the up and down counter 50 are made "7". The contents "7" of the up and down counter 50 are outputted at a frequency 2 Hz from the up and down counter 50 and are displayed by flashing at the hour display unit 17. When the setting switch S2 is operated twice in succession, upon the first operation of the switch S2, "1" is written in the 3:07 PM bit of the upper 60 bit register of the RAM 22, and "0" is written in the bit of the lower register. Upon the second operation of the switch S2, "0" is written in the 3:07 PM bit of the upper 60 bit register, and "1" is written in the bit of the lower register. The time information written in the RAM 22 is displayed at the time display unit 11 in a manner as shown in FIG. 5D. In this case, the first liquid crystal electrode element for displaying the minute flashes at the minute display unit 12 at a frequency of 2 Hz, and the second liquid crystal electrode element flashes at a frequency of 1 Hz.

After setting the times of the time schedule for 3:00 to 3:59 PM with the switch S4 in a similar manner, the setting switch S2 is operated once in the case of an ordinary train and twice in the case of an express train. FIG. 6 shows the stored condition of the times for 3:00 to 3:59 PM written in the RAM 22 in this manner. In the example shown in FIG. 6, 3:02, . . . 3:49 and 3:59 PM are stored for the ordinary train, and 3:07, . . . and 3:54 PM are stored for the express train.

The operation mode and operating method for reading and displaying the time schedule for 3:00 to 3:59 PM stored in the manner shown in FIG. 6 will be described. The present time is assumed to be 2:50 PM and this is displayed at the time display unit 11. Then the switch S1 is operated once to change the contents of the ternary counter 21 from "0" to "1". Then a signal f1 is generated so that the hour information "2 PM" is preset in the up and down counter 28 through the AND gates 26 and 27. When the hour information "2 PM" is preset, the time information for 2:00 to 2:59 PM is displayed at the time display unit 11.

When the switch S4 is operated once after visually observing the time display unit 11, the contents of the up and down counter 28 are incremented by 5 and become "3 PM". Then, according to the contents of the up and down counter, "3 PM" is displayed at the hour display unit 17 of the time display unit 11 by constant lighting the first liquid crystal electrode element and the second liquid crystal electrode element. The contents of the up and down counter 28 and the sexagenary counter 30 are decoded by the decoders 29 and 31 so that time information for 3:00 to 3:59 PM is read out from the RAM 22. The time information is then input to the shift registers $38_1$ and $38_2$ and is supplied to the minute display unit 12. Thus, the minute information for 3:00 to 3:59 PM is displayed at the minute display unit 12 by constant illumination for ordinary trains as shown in FIG. 7, and by flashing at a frequency of 1 Hz for express trains.

Although the present invention has been described as applied to an electronic wristwatch in the above embodiment, the present invention is not limited to this and is similarly applicable to other compact electronic devices having a function of displaying time such as a time schedule, for example, a compact electronic calculator.

What is claimed is:

1. An electronic device having a timing display function comprising:

present time counting means for counting reference signals to obtain present time data comprised of at least hour unit data and minute unit data;

analog display means including at least 60 optical indicators for causing the present time data obtained at the present time counting means to be displayed by the display position of selected indicators of said at least 60 optical indicators;

time data storing means for storing a plurality of time data different from the present time data obtained at the present time counting means, said time data stored in said time data storing means comprising at least hour unit data and minute unit data;

readout means coupled to said time data storing means for selectively causing only a plurality of different time data which are of the order of hour unit data the same as hour unit data obtained at the present time counting means to be read out of said time data storing means; and display control means coupled to said display means and to said readout means for causing at least the minute unit data of said plurality of different time data read out by said readout means to be simultaneously displayed by the display position of selected indicators of said at least 60 optical indicators.

2. The electronic device of claim 1, further comprising external operation switch means coupled to said readout means for selectively causing a plurality of time data which are of the order of an hour unit the same as hour unit data following the hour unit data obtained from said present time counting means to be read out of said time data storing means by the operation of said external operation switch means, and at least the minute unit data thereof being displayed on said analog display means.

3. The electronic device of claim 1, wherein said analog display means comprises a first analog display section comprised of radially arranged optical indicators and a second analog display section comprised of at least 60 optical indicators arranged outside said first analog display section, the hour unit of said plurality of time data read out of said time data storing means being displayed on said first analog display section, and the minute unit data of said plurality of time data read out of said time data storing means being simultaneously displayed at least on said analog display section.

4. An electronic device having a time display function comprising:

present counting means for counting reference signal to obtain present time data comprised of at least hour unit data and minute unit data;

time data storing means for storing a plurality of time data associated with at least two time tables, said time data stored in said time data storing means comprising at least hour unit data and minute unit data;

first external operation switch means coupled to said time data storage means and being operable to cause the reading out of time data from said time data storing means;

readout means coupled to said time data storage means and being responsive to operation of said first external operation switch means for selectively causing only a plurality of time data which are of the order of hour unit data the same as the hour unit data obtained from said time data counting means to be read out of said time data storing means, said plurality of time data read out from said time data storing means being from among a plurality of time data associated with said at least two time tables as stored in said time data storing means; and display means coupled to said readout means for simultaneously displaying at least minute unit data of said plurality of time data read out by said readout means, said display means comprising an analog display device having at least 60 optical indicators and display control means for causing the time data associated with said two time tables to be separately displayed on selected indicators of said at least 60 optical indicators of said analog display device.

5. The electronic device of claim 4, further comprising second external operation switch means coupled to said readout means for causing a plurality of time data which are of the order of hour unit data the same as hour unit data following the hour unit data obtained from said present time counting means to be read out of said time data storing means by the operation of said second external operation switch means, and at least the minute unit data thereof being displayed on said analog display means.

6. The electronic device of claim 4, wherein said analog display device comprises a first analog display section comprised of radially arranged optical indicators and a second analog display section comprised of at least 60 optical indicators arranged outside said first analog display section, the hour unit of said plurality of time data read out of said time data storing means being displayed on said first analog display section, and the minute unit data of said plurality of time data read out of said time data storing means being simultaneously displayed at least on said analog display section.

7. The electronic device of claim 4, wherein said at least two time tables stored in said time data storing means comprises a first time table associated at least with weekdays and a second time table associated with holidays.

* * * * *